United States Patent [19]

Krause, Jr. et al.

[11] Patent Number: 4,510,995

[45] Date of Patent: Apr. 16, 1985

[54] DOWNHOLE LOCKING APPARATUS

[75] Inventors: William F. Krause, Jr., Spring; Mark E. Hopmann, Houston, both of Tex.

[73] Assignee: Baker Oil Tools, Inc., Orange, Calif.

[21] Appl. No.: 468,421

[22] Filed: Feb. 22, 1983

[51] Int. Cl.[3] ..... E21B 23/02

[52] U.S. Cl. ..... 166/217; 166/382; 285/3; 285/141

[58] Field of Search ..... 285/3 X, 141 X, 140, 285/18; 166/123, 125, 134, 138, 206, 208, 216, 217, 237, 382

[56] References Cited

U.S. PATENT DOCUMENTS

| | | | |
|---|---|---|---|
| 3,130,788 | 4/1964 | Cochran et al. | 166/237 |
| 3,208,531 | 9/1965 | Tamplen | 166/125 |
| 3,633,670 | 1/1972 | Brown et al. | 166/125 |
| 3,670,821 | 6/1972 | Tamplen . | |
| 3,677,346 | 7/1972 | Tamplen | 166/315 |
| 3,856,081 | 12/1974 | Canalizo | 166/217 |
| 4,018,275 | 4/1977 | Gaut | 166/217 |
| 4,043,390 | 8/1977 | Glotin | 166/217 |
| 4,161,984 | 7/1979 | Watkins | 166/217 |
| 4,254,829 | 3/1981 | Watkins | 166/134 |
| 4,295,528 | 10/1981 | Carmody | 166/315 |
| 4,353,420 | 10/1982 | Miller | 166/382 |

*Primary Examiner*—Stephen J. Novosad
*Assistant Examiner*—William P. Neuder
*Attorney, Agent, or Firm*—Norvell & Associates

[57] ABSTRACT

A locking apparatus for positioning a well tool within a subterranean well bore and comprising a primary locking member attached to the well tool; a nipple incorporable in a subterranean well conduit; and running and retrieving tools for positioning the lock member is disclosed. The lock has a no-go shoulder for initially positioning the lock adjacent the nipple and radially expandable locking dogs for carrying both upwardly and downwardly directed forces upon full expansion thereof after the no-go shoulder has been disengaged. At least two interlocking members disengagable only by separate manipulations maintain the locking dogs in a radially expanded fully engaged position. A retrieving tool having a rotational alignment means to position the tool relative to the lock is used to separately manipulate the interlocking members and to pull the disengaged lock from the well.

17 Claims, 4 Drawing Figures

DOWNHOLE LOCKING APPARATUS

BACKGROUND OF THE INVENTION

1. Field of the Invention

This invention relates to well tools used in the completion of oil and gas wells and more specifically to locking apparatus for positioning well tools, such as safety valves, in nipples within subterranean well conduits, such as tubing strings.

2. Description of the Prior Art

A common method of positioning a subterranean well tool at a desired position within a well conduit, such as a tubing string, is to use a locking apparatus attached to the well tool to anchor the tool in the well. Normally the lock is attached to the top of the well tool and a wireline running tool is attached to the lock to lower the assembly into the well. The lock will normally have an outwardly projecting no-go shoulder for engaging a cooperable no-go shoulder on the nipple to position the lock adjacent to the annular recess in the nipple. Outwardly expandable members, such as collets or discrete locking dogs, are employed to engage the annular recess within the nipple. Normally these locking dogs will secure the lock against upward movement while engagement of the no-go shoulders will prevent downward movement of the well tool. The radially expandable members on conventional locking apparatus can be expanded outwardly by means of springs, by shifting one member to release inherently radially flexible collets, or by shifting an inner mandrel beneath the collets or locking dogs to force the radially expandable members outward into engagement with the nipple. Interlocking means, such as the inherent flexibility of a collet or a separate shearable member, can be used to hold the radially expandable member in engaged position.

When it becomes necessary to release the lock, it is customary to insert a wireline retrieving tool into the lock to disengage a shearable member and thus permit the radially expandable locking dogs or collets to flex inwardly releasing the lock. For example, it is common practice to use a ratcheting device which will permit axial telescoping movement between two components of the lock so that the radially expandable members can be shifted outward. A separate shearable member, such as a shear pin which can be severed upon application of a sufficient upwardly directed force, can then be used to release the locking members.

SUMMARY OF THE INVENTION

A lock for use in anchoring a well tool, such as a safety valve, comprises one or more radially expandable members, such as locking dogs, for engaging a cooperable nipple profile incorporated into a well conduit, such as a tubing string. The lock comprises an inner mandrel which is downwardly shiftable relative to an outer housing. The radially expandable locking dogs are contained within the outer housing and downward movement of the mandrel is effective to shift the locking dogs radially outward into engagement with the nipple profile. A no-go shoulder located on the exterior of the lock engages a cooperating no-go shoulder on the nipple to position the lock with the locking dogs adjacent the nipple profile. Outward movement of the locking dogs is effective to shift the outer housing upward relative to the nipple as the mandrel is being shifted downwardly relative to the outer housing and the nipple. Upward movement of the outer housing moves the no-go shoulders out of engagement so that upward and downward forces applied to the lock will be carried by the locking dog, and the no-go shoulder will not carry downwardly directed forces.

Two separate interlocking members, such as radially biased C-rings, are used to engage both the mandrel and outer housing to prevent movement of the mandrel relative to the outer housing and locking dogs when the locking dogs are radially expanded. These separate interlocking members are released by separate manipulation. One locking member is released by application of a sufficient axial force to the mandrel to cause the locking member to be cammed inwardly. The other locking member cannot be disengaged by axial force. This second locking member must be radially shifted to disengage from the mandrel to permit movement of the mandrel relative to the outer housing.

The outwardly shiftable locking member is aligned with one or more radial openings extending through the mandrel. The releasing tool utilizes one or more releasing dogs radially shiftable through the mandrel openings to shift the second or upper locking ring outwardly from engagement with the mandrel. The releasing dogs are positioned on a wireline retrieving tool and alignment between the releasing dogs and the mandrel openings is provided by interengaging aligning members on the releasing tool and on the mandrel. In the preferred embodiment of the invention, these aligning means serve to rotate the wireline retrieving tool upon insertion through the lock mandrel to align the releasing dogs with the lock mandrel openings. These cooperable aligning members comprise inwardly projecting surfaces on the lock mandrel and cooperable grooves on the exterior of the retrieving tool.

DETAILED DESCRIPTION OF THE PREFERRED EMBODIMENT

Figure 1A:
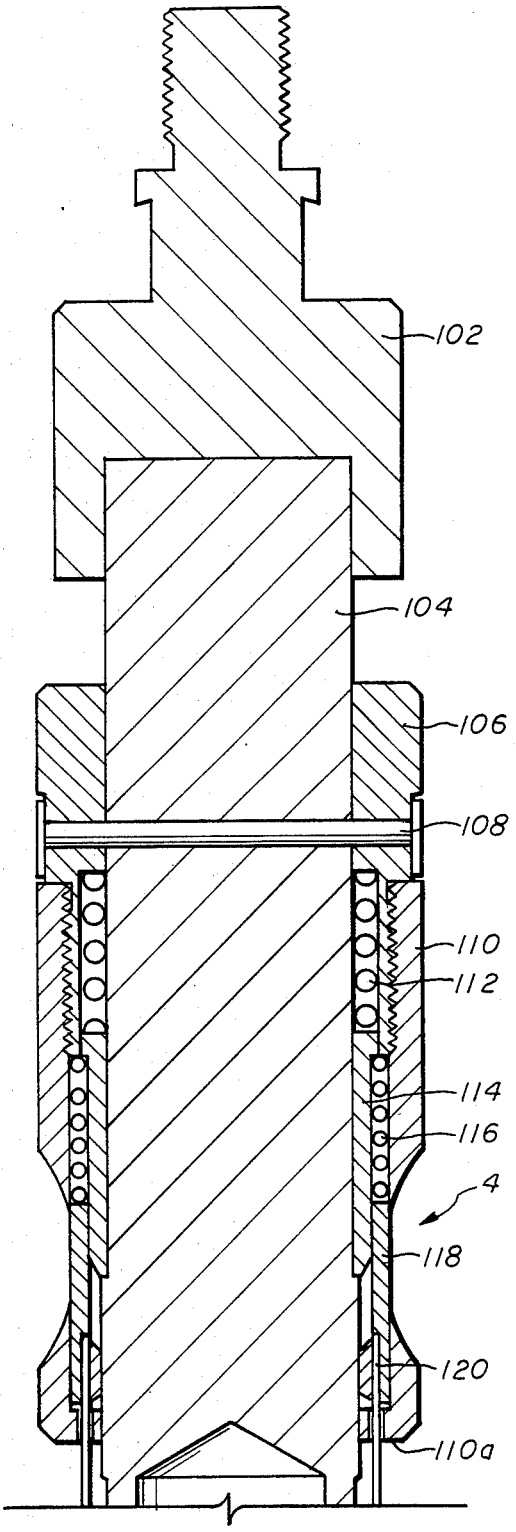
FIG. 1 shows the lock positioned adjacent a nipple while attached to the running tool.

The assembly used to lower and position a lock in place and retrieve the lock after disengagement comprises a lock 2, a running tool 4, and a retrieving tool 6. The lock 2 is attached to a downhole tool 10 such as a safety valve, which is to be positioned within a conduit, such as tubing string. The lock 2 is positioned in the tubing string by securing the lock 2 to a nipple 8 having an annular recess 8*a* with inclined surfaces 8*b* and 8*c* at the upper and lower ends of the nipple respectively. Nipple 8 also has an inwardly projecting annular shoulder 8*d*, constituting a radial restriction within the tubular conduit, to serve as a no-go shoulder. No-go shoulder 8*d* projects inwardly beyond any shoulder on the nipple 8 and beyond the inner surface or bore of the tubing conduit or tubing string in which nipple 8 is incorporated. No-go shoulder 8*d* serves as a locating member and is axially spaced from nipple recess 8*a*. As shown herein, the no-go shoulder 8*d* is located below the nipple recess. The no-go shoulder can, however, be positioned above nipple recess 8*a*, necessitating a similar repositioning of the cooperating no-go shoulder located on the lock itself.

Figure 1B:
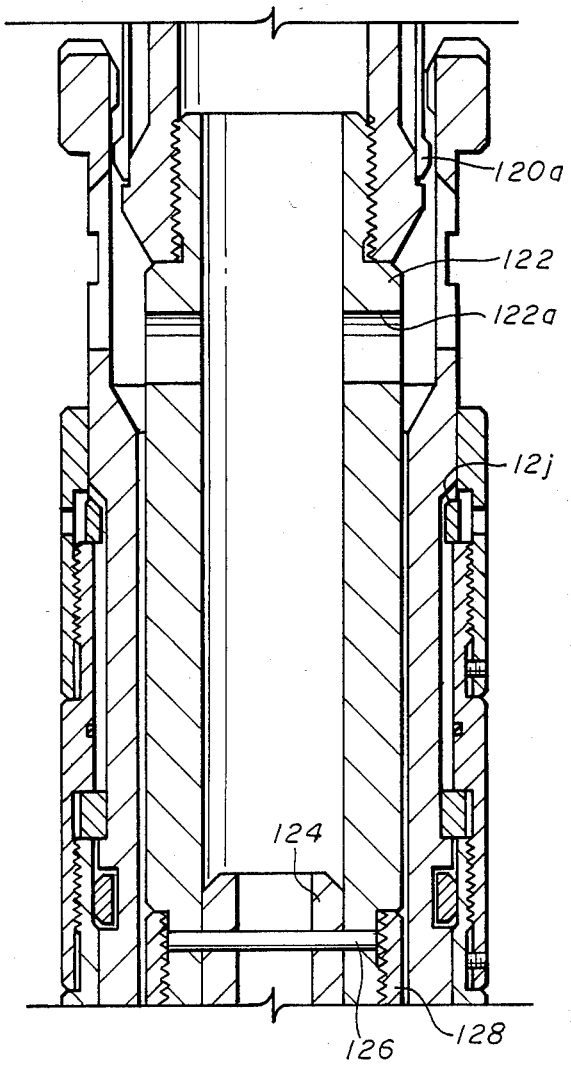
Figure 1C:
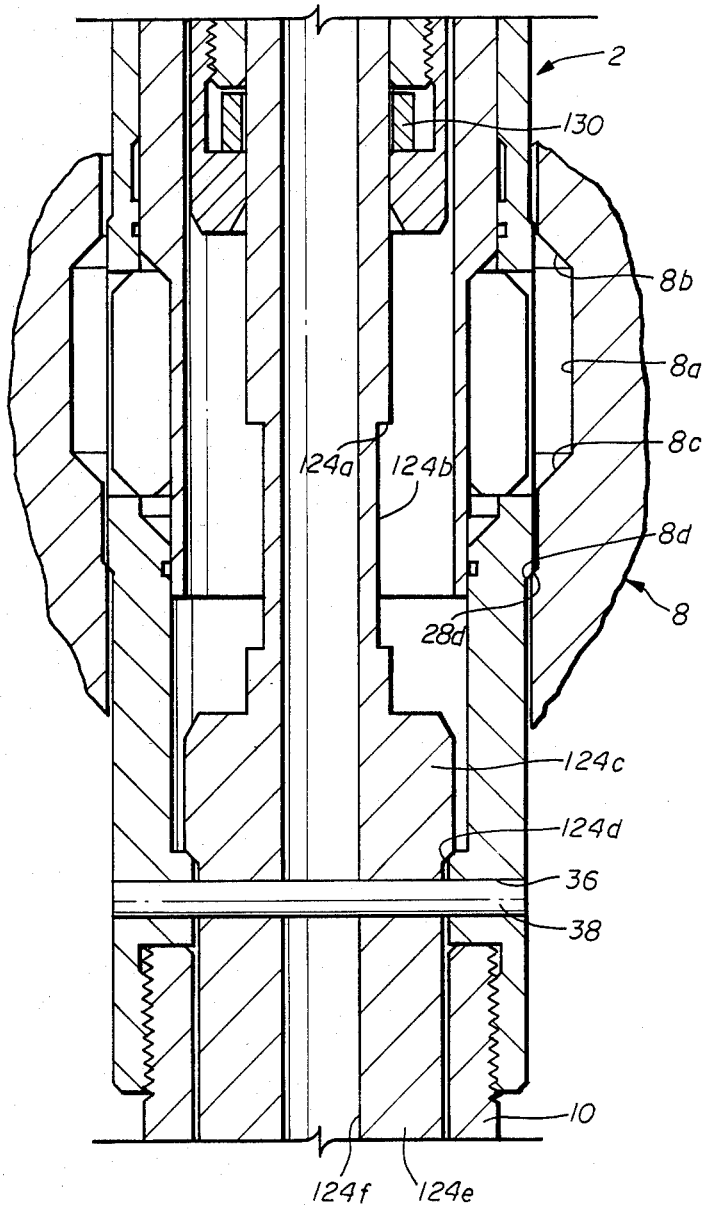
Figure 2:
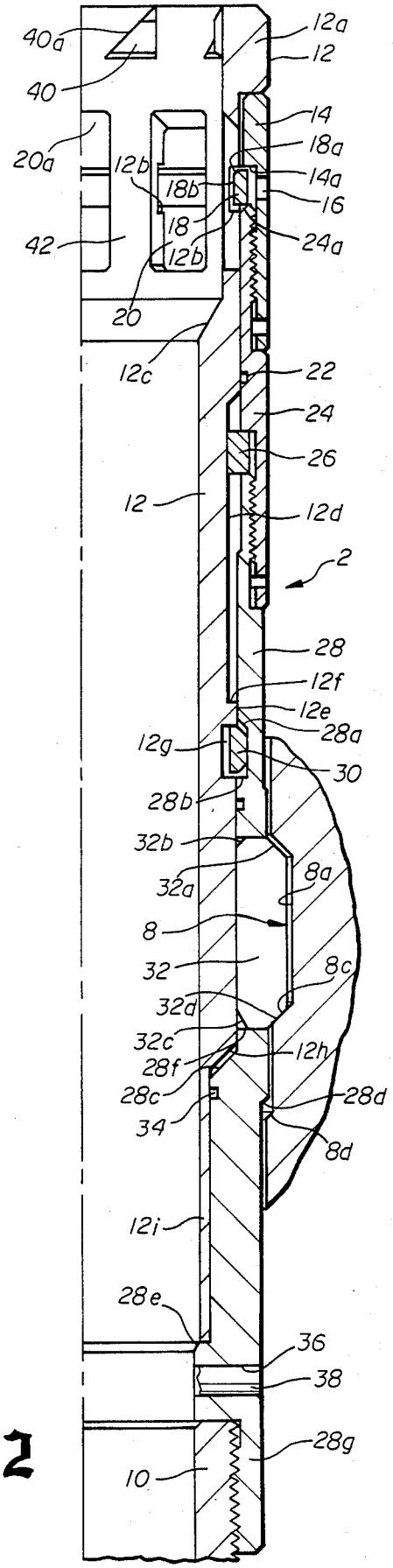
FIG. 2 shows the lock in the fully engaged position.

Lock 2 is shown in the retracted or disengaged position in FIG. 1 and in the expanded or engaged position in FIG. 2. One or more radially expandable locking dogs 32 comprise the means for establishing locking engagement with the nipple recess 8*a* upon full expansion of locking dogs 32. In general, a plurality of locking dogs 32 will be equally circumferentially spaced around lock 2. In the preferred embodiment of this invention, each locking dog 32 comprises a solid metal member having inclined or chamfered edges 32*a*–32*d*. In the preferred embodiment of this invention, the downwardly and outwardly facing inclined surface 32*d* is inclined at substantially the same angle as the lower upwardly facing nipple recess surface 8*c*. This similarity can be seen in FIG. 2.

Locking dogs 32 are retained within an outer housing 28 having radially extending windows 28*f* for receiving each locking dog. A circumferentially extending lip (not shown) on the lower surface of each locking dog 32 overlaps portions of the outer housing 28 to limit radial expansion of locking dogs 32 relative to outer housing 28. Thus the maximum outward expansion of locking dogs 32 will be defined by abutment of these inner overlapping surfaces with the interior of the outer housing adjacent openings 28*f*. Although locking dogs 32 are free to move through a limited radial travel, locking dogs 32 are held axially fixed relative to outer housing 28 by abutment of the upper and lower faces of the locking dogs with corresponding faces of windows 28*f*.

In addition to outer housing 28, the outer section of lock 2 comprises upper and lower lock ring housing retainers 14 and 24. Lower lock ring housing retainer 24 is attached to the upper end of outer housing 28 by a conventional threaded connection. An annular pickup ring 26 is positioned between oppositely facing shoulders of outer housing 28 and lower lock ring retainer 24 adjacent the threaded connection therebetween. Upper lock ring retainer housing 14 is attached by a conventional threaded connection to the upper end of the lower lock ring housing 24. One or more radially extending sand ports 16 extend through upper lock ring retainer housing, and a downwardly facing shoulder 14*a* on retainer 14 is spaced from an oppositely facing shoulder 24*a* on the lower retainer to provide axial clearance adjacent port 16.

An inner mandrel 12 is positioned concentrically within the outer housing section comprising housing 28 and retainers 14 and 24. Mandrel 12 is axially shiftable relative to the outer housing section. The mandrel 12 is shown in the first or upper position in FIG. 1 and in the second or actuated position in FIG. 2. An enlarged section 12*a* is located at the upper end of mandrel 12. Section 12*a* comprises a section of increased thickness extending circumferentially around the upper end of the mandrel 12. Immediately below enlarged section 12*a* a plurality of radially extending openings 20 extend completely through the thinner section of the mandrel below section 12*a*. One or more openings are positioned circumferentially around the inner mandrel 12. On the exterior of the thin section of mandrel 12 in alignment with the openings 20, an annular groove 12*b* is positioned around the exterior of mandrel 12. Groove means 12*b*, in essence, comprise circumferential extensions of a single groove which intersect the axially extending webs 42 extending between openings 20. Webs 42 comprises an integral part of mandrel 12. An upwardly facing inwardly inclined surface 12*c* is located at the lower extent of the thin section containing openings 20 in mandrel 12. Inclined surface 12*c* defines a thickened section of mandrel 12 and insures that openings 20 and webs 42 are recessed from the inner bore of lock mandrel 12.

An axially extending groove 12*d* extending entirely or partially around the outer surface of mandrel 12 is located axially below inner surface 12*c*. This axially extending groove 12*d* has an upwardly facing square shoulder 12*f* located at its lower end. Shoulder 12*f* comprises the upper surface of an integral annular shoulder on the exterior of mandrel 12 with a lower annular groove 12*g* being defined immediately below shoulder 12*e*. Axially spaced from annular groove 12*g* is a downwardly facing camming surface 12*h* on the exterior of mandrel 12. Camming surface 12*h* is inclined and downwardly facing and defines the upper extent of a thin lower mandrel section 12*i*.

A shoulder 28*e* is located on the lower portion of outer housing 28 immediately below the fully extended position of thin mandrel section 12*i*. Shoulder 28*e* protrudes within the inner bore of mandrel 12 and defines an upwardly facing inclined shoulder on a thickened annular section of outer housing 28. A radially extending hole 36 will receive a shear pin 38 which extends through the thickened annular section 28*g* containing shoulder 28*e*. Below section 28*g* a conventional threaded connection is provided at the lower end of lock 2 for attachment to a conventional well tool such as a wireline safety valve. The shear pin hole 36 and shear pin 38 provide means for attaching the lock 2 to a running tool for lowering the lock and well tool assembly into the well into a position adjacent nipple 8.

The running tool 4 is shear pinned to the outer housing 28 below dogs 32 and below the upwardly positioned outer housing 28 on lock 2. This running tool comprises a conventional wireline running tool used for wireline operations to position downhole tools in a well bore. A running tool mandrel 122 and running tool prong 124 extending through the bore of the lock and attached well tool extending from the lower portion of the conventional running tool. The running tool mandrel 122 is attached to running tool body 104 and extends through the upper portion of lock 102 in the running position shown in FIG. 1. The running tool mandrel 122 is shear pinned to the running tool prong 124 by means of shear pin 126. A cylindrical pickup ring 130 comprising a split ring is positioned in abutting relationship to the lower end of running tool mandrel 122 and an outer ring retainer 128 is threadably connected to running tool mandrel 122 to maintain the pickup ring 130 in position below mandrel 122. Pickup ring 130 extends around the upper portion of running tool prong 124 immediately below shear pin 126. Pickup ring 130 is outwardly flexed in the position shown in FIG. 1 and contacts the outer surface of running tool prong 124 along a substantial portion of its circumference. Below the position of pickup ring 130 as shown in FIG. 1, a downwardly facing shoulder 124*a* is located on the running tool prong 140. Shoulder 124*a* defines the upper extent of an annular recess 124*b* extending along a portion of the outer surface of running tool prong 124. Below recess 124*b*, a thickened running tool prong shoulder 124*c* extends completely around the periphery of prong 124. Section 124*c* has a downwardly facing inclined shoulder 124*d* dimensioned to abut a cooperating shoulder 28*a* on the outer housing of lock 2. Shear pin 38 which extends through the outer housing 28 of lock 2 extends through a cooperating hole into the running tool prong 124 immediately below shoulder 124*d*. The lower portion 124*e* of the running tool prong 124 extends downwardly below lock 2 and into the well tool 10. When lock 2 is used in conjunction with a safety valve, prong 124*e* can extend downwardly through the valve closure member within the safety valve to maintain the valve in the open position while the assembly is being run through the well. Note that with the valve closure member of a safety valve in an open position pressure below the running assembly will be equalized since the open bore 124*f* of prong 124 extends through the valve closure member of the safety valve. A radial port 122*a* communicating with this running tool bore can then provide a flow path communicating with the tubing string above the running tool assembly while the lock and running tool assembly has been lowered into the well.

The only connection between running tool 4 and lock 2 is by means of shear pin 38 and this connection is located on the lower portion of lock housing 28. Therefore as the running tool and lock are being lowered into a well, the lock 2 is pulled and not pushed into the well. It will be apparent that there will be no tendency to prematurely set the lock due to compressive load applied by the running tool to the upper portion of lock 2 or lock mandrel 12.

Figure 3A:
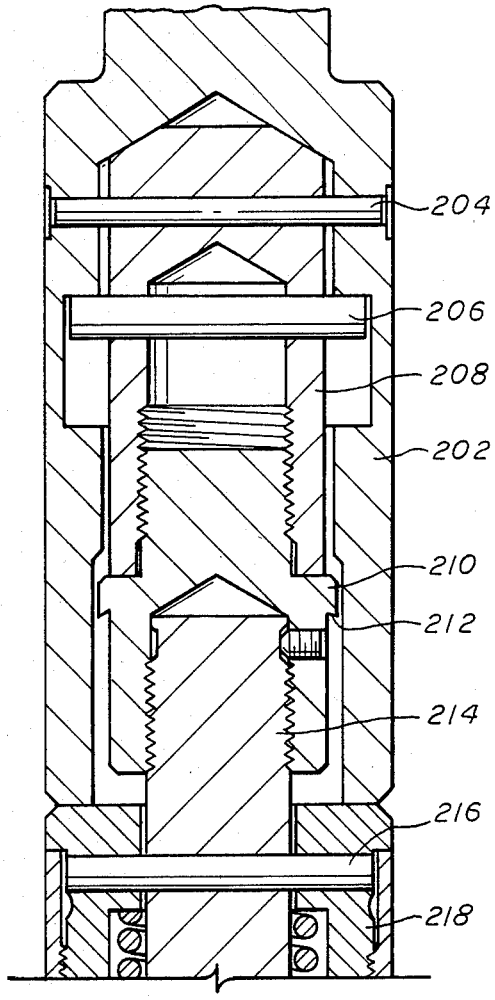
FIG. 3 shows the retrieving tool positioned prior to releasing the lock.
Figure 3B:
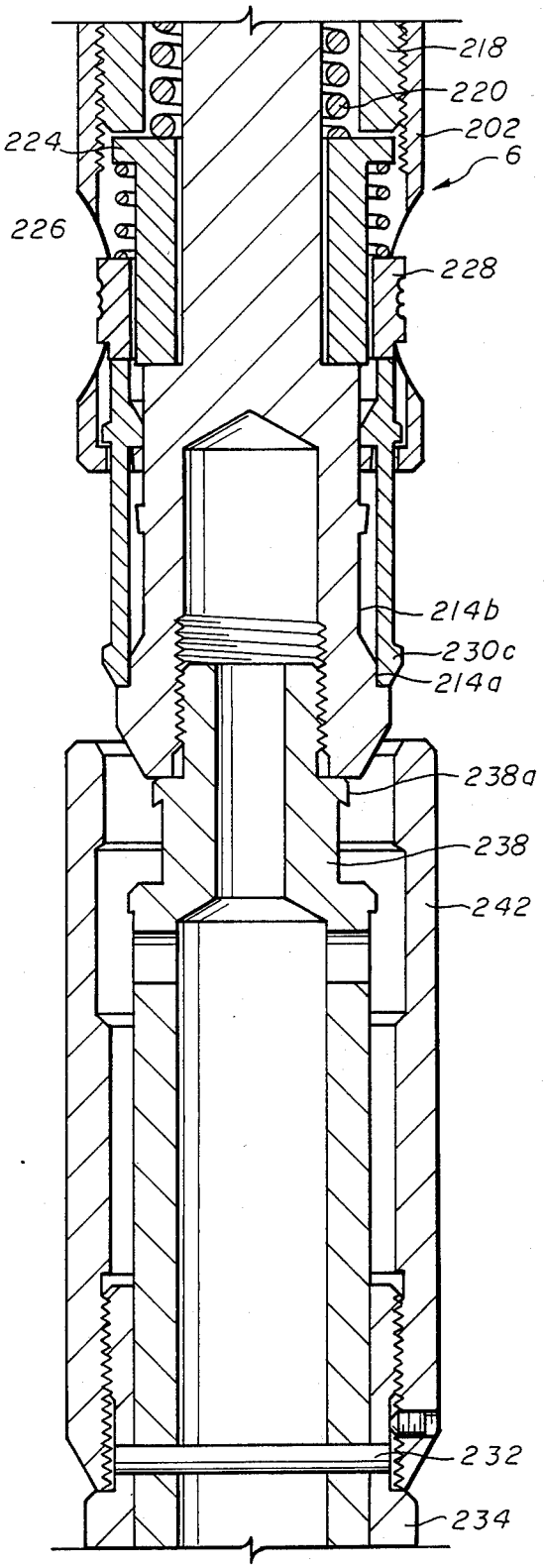
Figure 3C:
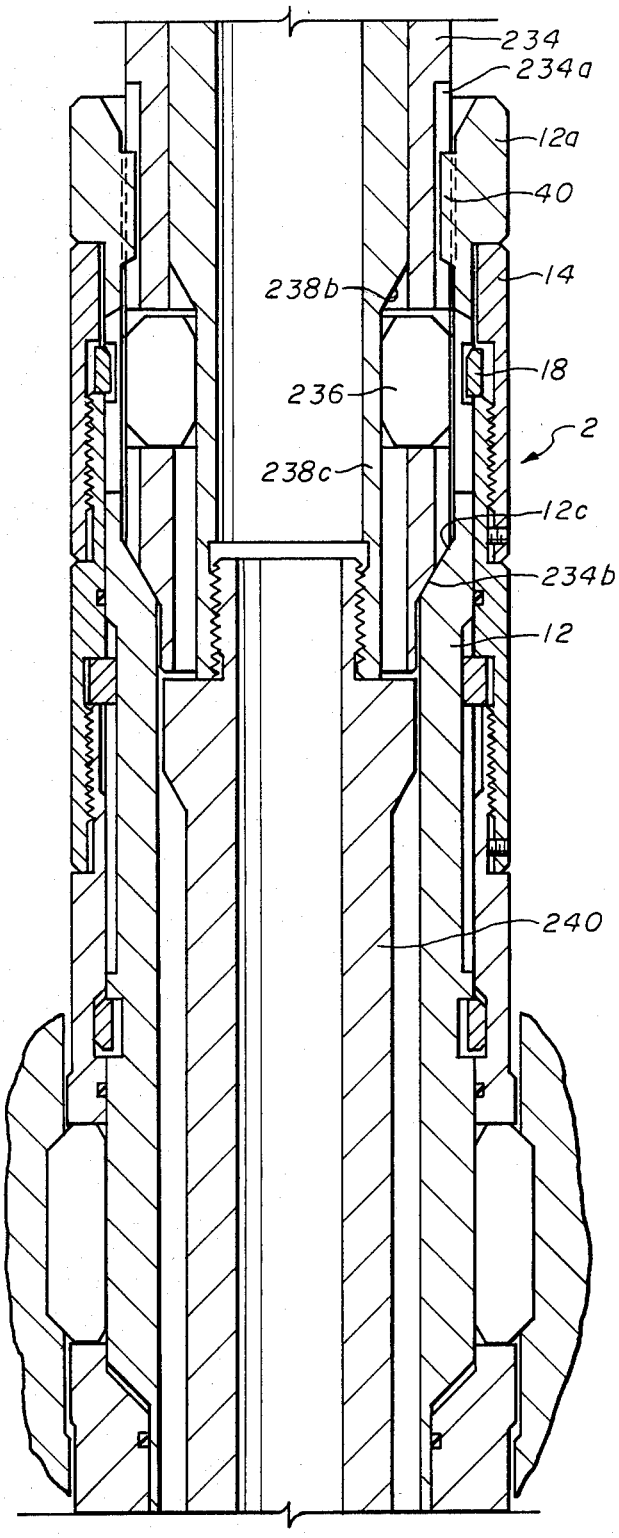
Figure 4A:
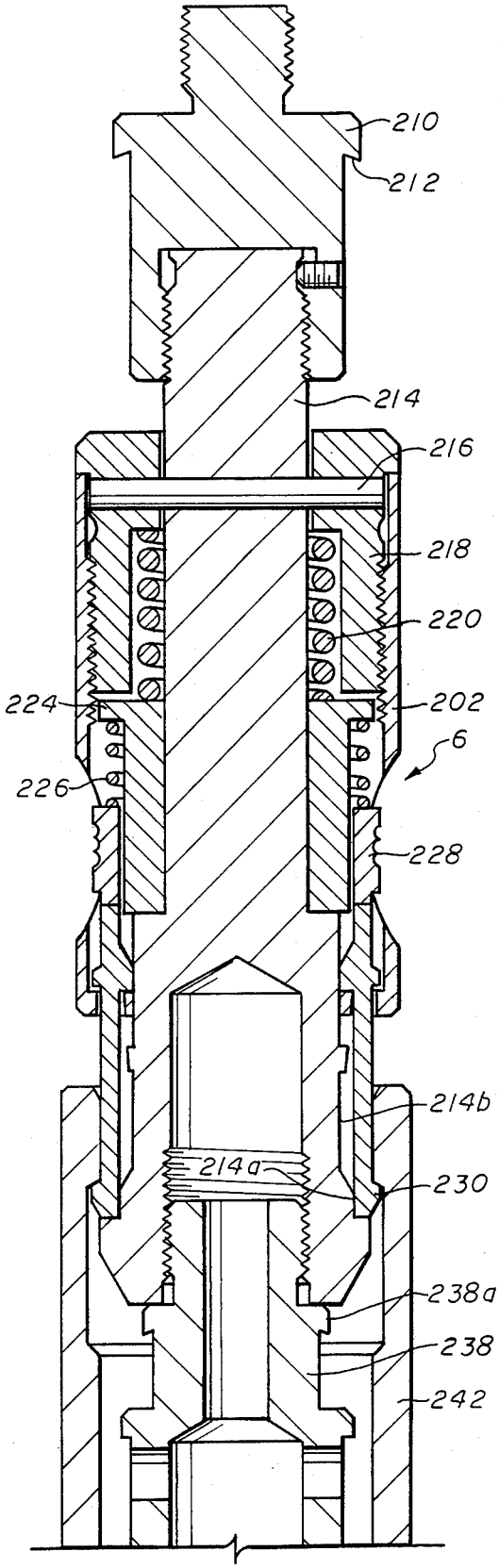
FIG. 4 shows the lock disengaged from the mandrel.
Figure 4B:
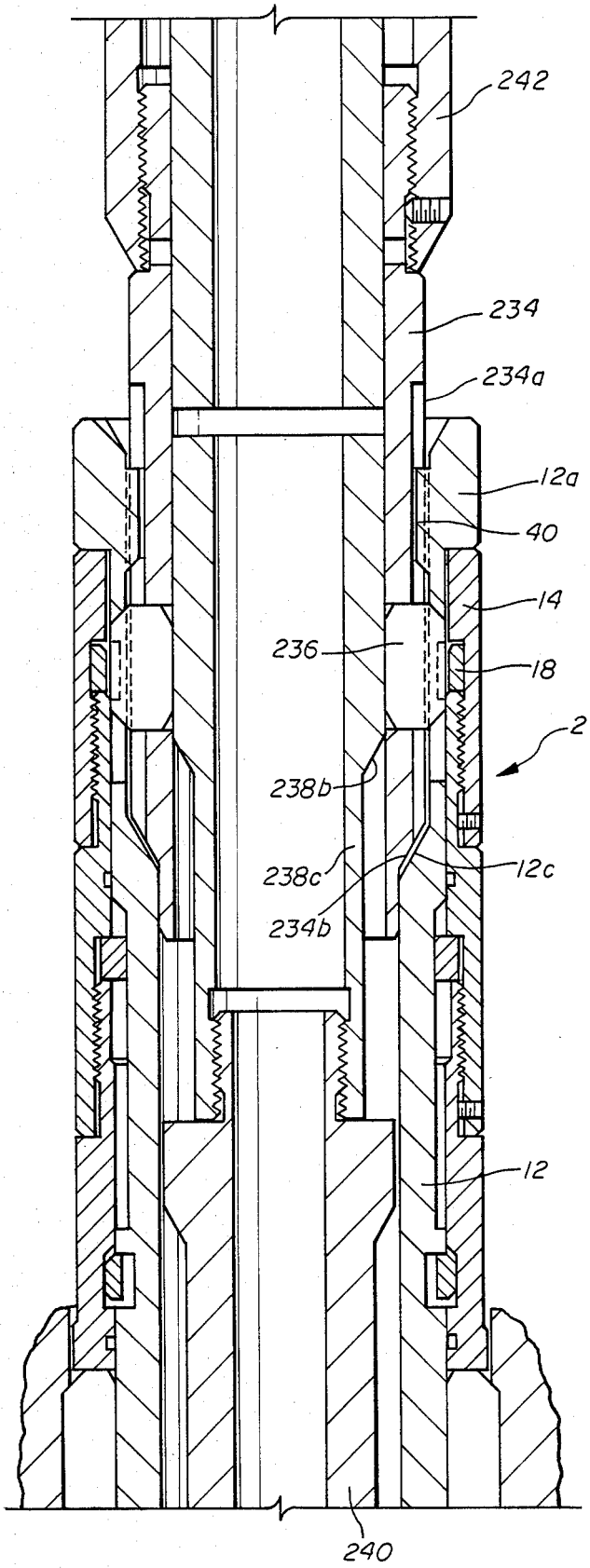

FIGS. 3 and 4 illustrate the use of a retrieving or pulling tool to disengage lock 2 and remove the lock and well tool assembly from a well. Again, the pulling tool comprises a wireline tool of conventional construction with a specially adapted lower assembly extending through the lock 2 and well tool 10. A retrieving tool prong 240 extends downwardly from the lower end of retrieving tool mandrel 238 and through the lock 2. Prong 240 can also extend within the well tool attached to lock 12 and, as with running tool prong 124, retrieving tool prong 240 can also hold a valve closure of an attached safety valve in the open position for retrieval.

OPERATION

FIGS. 1–4 illustrate the insertion of the assembled lock 2 and well tool 10 into a well on a running tool 4, the actuated position of the lock in engagement with nipple 8, and the retrieval of the lock and well tool assembly by retrieving tool 6. When the assembly is run into the well on running tool 4 as shown in FIG. 1, the lock is attached to the running assembly by means of shear pin 38. If a well tool 10, such as a safety valve with a valve closure member is used, running tool prong 124*e* will maintain the valve closure member in the open position during insertion of the lock and attached valve. During insertion of the assembly a shearing force will not be applied to shear pin 38 since the shoulder 124*b* on running tool prong 124 abuts a mating shoulder 28*e* on the interior of the lock housing 28. Thus the shiftable components of the lock will be pulled into the well by means of forces transmitted between these two shoulders. During insertion of the lock, lock mandrel 12 is in its upper position relative to outer lock housing 28 with the locking dogs 32 in their inwardly retracted position. Force is not applied by running tool 4 to mandrel 12 which would tend to shift the mandrel relative to housing 28 and therefore there is no tendency for locking dogs 32 to expand while the tool is being run into the well.

The lock 2 and running dogs 32 will be positioned adjacent the nipple 8 when outwardly projecting lock no-go shoulder 28*e* abuts the mating upwardly facing no-go shoulder 8*d* on the nipp1e. With the no-go shoulders abutting, downward movement of lock 2 is no longer possible. As shown in FIG. 1, the locking dogs 36 are adjacent to nipple recess 8*a*. Locking dogs 32 will not, however, be precisely aligned with nipple recess 8*a*. Downwardly facing inclined shoulder 32*d* on the exterior of locking dogs 32 will overlap the lower surface 8*c* of nipple recess 8*a*. This overlap, as shown in FIG. 1, is established because the distance from lock no-go shoulder 2*d* to the lower end of dogs 32 is less than the distance between nipple no-go shoulder 8*d* and the lower edge of surface 8*c* on nipple recess 8*a*. Note, however, that the lock assembly is dimensioned so that at least a portion of locking dog surface 32*d* will engage lower nipple inclined surface 8*c* upon radial expansion of the locking dogs 32.

When the no-go shoulders 28*d* and 8*d* are in contact, additional downward jarring on the running tool 4 will cause shear pin 126 on the running tool to be severed, thus releasing running tool mandrel 122 to move longitudinally downward relative to prong 124 which is held in position relative to lock 2 by abutment of surface 124*d* with lock shoulder 28*e*. In order to set lock 2, running tool mandrel 122 must shift downwardly until pickup ring 130 has been shifted below shoulder 124*a* on prong 124. When pickup ring 130 is aligned with prong recess 124*b*, pickup ring 130 will flex inwardly so that the pickup ring 130 will engage shoulder 124 upon subsequent upward movement of the running tool. Downward movement of running tool 4 and mandrel 122 is accompanied by abutment between shoulder 110*a* on the running tool and the upper face of mandrel section 12*a*. Downward movement of the running tool, accompanied by compression of springs 112 and 116, will therefore shift the mandrel 12 down relative to outer housing 28. Downward movement of mandrel 12 is possible only after locking ring 12*g* has been cammed inwardly so that the locking ring can shift down relative to outer housing 28 into locking ring retaining groove 28*b*, the position shown in FIG. 2. Downward movement of mandrel 12 will also cause mandrel camming shoulder 12*h* to engage the inclined surface 32*b* on locking dogs 32 to radially expand locking dogs 32. Radial expansion of locking dogs 32 will bring locking dog surface 32*d* into partial contact with nipple surface 8*c*. When initial contact is established between the locking dog and the nipple, lock no-go shoulder 28*d* will still be in engagement with nipple no-go shoulder 8*d*. These no-go shoulders will carry initial downward force transmitted through the running tool and mandrel to nipple 8 until the locking dogs engage the nipple profile. Engagement will occur until locking ring 30 is cammed inwardly to permit movement of mandrel 12 relative to the locking dogs 32. Thus the maximum force exerted on the nipple no-go shoulder 8*d* will be the force required to release locking ring 30, and excessive damage to the no-go shoulder can be avoided. Partial engagement between locking dog surface 32*d* and nipple surface 8*c* will cause the locking dog 32 to shift axially upward relative to nipple 8 during the latter stages of radial expansion of locking dog 32. When locking dog 32 has been fully expanded, as shown in FIG. 2, the locking dog 32 will have been shifted upward relative to the nipple. This upward movement of locking dogs 32 will also cause the outer housing 28 of lock 2 to shift upward relative to nipple 8. Upward movement of outer housing 28 relative to nipple 8 will cause lock no-go shoulder 28*d* to move upward relative to nipple no-go shoulder 8*d*. Therefore the no-go shoulder will no longer carry downwardly directed forces transmitted through the lock to the nipple. The locking dog itself will carry these downwardly directed forces as well as any upwardly directed forces applied to the lock. Since radial expansion of locking dog 32 is initiated by downward movement of mandrel 12 relative to outer housing 28 and to nipple 8, both the mandrel 12 and the outer housing 28 move relative to nipple 8 during actuation of locking dogs 32.

Downward movement of mandrel 12 relative to outer housing assembly 14, 24 and 28 will result in engagement of two locking rings 18 and 30 with both the mandrel 28 and the outer assembly. A first releasable locking member or lower locking ring, or flexible C-ring having free ends, 30 is held in position within groove 12*g* on the mandrel. This lower locking ring 30 is also held in a small groove on the interior of outer housing 28 in the expanded running position of the lock shown in FIG. 1. Downward movement of mandrel 12 relative to outer housing 28 is possible only when the locking ring 30 is cammed inwardly to pass this shoulder on the outer housing. Lock ring 30 is outwardly biased and inwardly flexed in the position shown in FIG. 1, but an axial force will be effected to shift locking ring 30 slightly inwardly to permit the locking ring and mandrel to shift down relative to the outer housing 28. When locking dogs 32 have been fully expanded by downward movement of mandrel 12, lower locking ring 30 will have shifted into alignment with a groove 28*b* on the interior of outer housing 28 immediately above the locking dogs. Lock ring 30 is then free to outwardly expand to engage groove 28*b*. When locking ring 30 has engaged groove 28, the mandrel cannot be shifted upward relative to outer housing 28 until an axial force is applied to the mandrel sufficient to cam outwardly biased locking ring 30 inwardly to disengage ring 30 from groove 28*b*.

A split ring locking member 18, which is inwardly biased, is positioned between upper lock ring housing 14 and lower lock ring housing 24. In the position shown in FIG. 1, upper lock ring 18 is positioned immediately below a downwardly facing camming surface 12*j* on the exterior of mandrel 12. Downward movement of mandrel 12 relative to the housing assembly 14, 24 and 28 will upon the application of a sufficient downwardly directed force, cause lock ring 18 to be expanded by shoulder 12*j*. Note that a cooperating inclined surface 18*a* is located at the upper edge of lock ring 18. The lower shoulder 18*b* of the upper lock ring is, however, a squared and not an inclined surface. When upper lock ring 18 has been cammed outwardly, it will shift upward with outer housing assembly 14, 24 and 28 relative to downwardly moving mandrel 12 until the inwardly biased lock ring 18 has been shifted into alignment with groove 12*b* formed in mandrel webs 42 in alignment with mandrel opening 20. When the mandrel 12 has been shifted downward relative to outer housing through the entire length of its travel, inwardly biased upper lock ring 18 will shift downward into groove 12*b*. The upper square shoulder on the exterior of lock ring 18 will then abut downwardly facing shoulder 14*a* and will prevent upward movement of mandrel 12 relative to the outer housing assembly until the upper C-ring 18 has been shifted radially outward relative to the mandrel to disengage the lock ring 18 from mandrel groove 12*b*. In the engaged position of FIG. 2, it is apparent that the lock ring 18 is recessed from the main flow bore of the lock mandrel 12.

A second C-ring 24 is axially shiftable within groove 12*d* between the position abutting shoulder 12*f* shown in FIG. 1 and the position shown in FIG. 2. Ring 26 is fixed relative to the outer housing assembly 14, 24 and 28, but ring 26 does not impede downward movement of mandrel 12 from the position of FIGS. 1–2 or upward mandrel 12 from its position of FIG. 2 to the position shown in FIG. 1. Ring 26 comprises a pickup ring for use in retrieving the lock and valve assembly. When locking dogs 32 are fully engaged, the running tool 4 is removed by pulling upwardly on the ruuning tool. Full engagement of the lock will permit running tool ring 130 to engage prong shoulder 124*a*. Upward movement of the running tool will then result in shearing pin 38 to release the connection between the running tool and the lock. The running tool prong 124 and the running tool mandrel 122 will then be removed with the conventional running tool and the well tool will have been positioned to anchor in engagement with the subterranean well conduit by means of lock 2 and nipple 8. If for some reason the locking dogs 32 have not been fully expanded to engage nipple 8 and upper recess surface 8*b*, pin 32 will not be sheared and the running tool and well tool assembly will be removed. If for some reason the mandrel 12 has not been shifted completely downward, ring 130 will not have shifted into engagement with prong surface 124*a* and the running tool prong 124 will not be retrieved with the running tool. Failure to retrieve the running tool prong 124 will tell the operator at the surface that the lock has not been fully set.

When it becomes necessary to retrieve the lock and well tool assembly from the well, a running tool 6 having releasing dogs 236 can be inserted into the well. FIG. 3 illustrates the running tool after it has been inserted into the well until shoulder 234*c* on release housing 234 of the retrieving tool has been positioned in abutment with surface 12*c* on the interior of the mandrel. Abutment of these surfaces will align releasing dog 236 with the upper locking ring 18 holding the mandrel 12 fixed relative to the outer housing assembly of the lock. The running tool 4 can be lowered into position shown in FIG. 3 only after the releasing dogs 236 have been aligned with the mandrel openings 20 of the lock. This rotational alignment is accomplished by means of the inwardly projecting camming surfaces 40 on the interior of lock mandrel 12 which are adapted to abut the lower surface of pulling tool release housing 234. The upwardly inclined surfaces 40*a* on the inwardly projecting members will cause a misaligned retrieving tool to rotate counterclockwise until the axially extending grooves 234*a* on the exterior of release housing 234 are aligned with projections 40. Projections 40 can then be received within grooves 234 and the retrieving tool can be shifted fully into the position shown in FIG. 3. When surfaces 234*b* and 12*c* are in alignment, releasing dogs 236 will be in a position to be shifted through mandrel openings 20 between mandrel webs 42. At this point a downward force can be applied to the retrieving tool and after pin 204 has sheared, retrieving tool body 214 can be shifted downwardly causing retrieving tool mandrel 238 to shift downward relative to release housing 234. Release housing 234 cannot shift downwardly because of abutment between surfaces 12*c* and 234*b* and is held in position by the fully engaged lock. Shear pin 232 must be sheared before downward movement of mandrel 238 relative to housing 234 is possible. Surface 238*b* on mandrel 238 will cause releasing dogs to be cammed outwardly upon downward movement of mandrel 238 relative to the releasing dogs. These releasing dogs will then be cammed into lock mandrel openings 20. Full expansion of releasing dogs 236 will bring them into engagement with inwardly biased radially flexible locking ring 18. The fully expanded releasing dogs 236 will force upper locking ring 18 outward so that this ring will no longer engage groove 12*b* on the mandrel. Lock ring 18 will then no longer prevent upward movement of mandrel 12 relative to outer housing assembly 14, 24 and 28. Downward movement of the retrieving tool body 214 will also cause latch 230 to engage a fishing neck 242 attached to release housing 234 on the retrieving tool. When the retrieving tool has been positioned as shown in FIG. 4, an upward force applied to the retrieving tool will be transmitted to latch 230 and fishing neck 242 to release housing 234. Since releasing dogs 236 are received within line openings in release housing 234 and in the lock mandrel 12, the upward force on the retrieving tool is transmitted to the mandrel 12. Releasing dogs 236 cannot be shifted inwardly because of engagement of retrieving tool mandrel 238 with the lower surface of the releasing dogs. Mandrel 238 cannot be shifted upward to release housing 234 because of the engagement between latch 230, body 214 and fishing neck 242 as shown in FIG. 4. Thus an upward force applied to retrieving tool 4 will initially result in upward movement of lock mandrel 12 which is no longer held fixed by outwardly expanded locking ring 18. Upward movement of mandrel 12 is possible after application of a sufficient upwardly directed axial force to cause lower locking ring 30 to be cammed inwardly by surface 28*a* on the outer housing groove 28*b*. With both lock rings 18 and 30 disengaged by different manipulations, the mandrel is now free to move upward relative to the outer housing to release locking dogs 32. Continuing upward force should therefore be adequate to remove the lock and well tool assembly from the well.

The preferred embodiment of this invention therefore discloses a locking apparatus and method for securing or anchoring a well tool, such as a safety valve, in a subterranean well conduit. The lock and its associated running tool are adapted so that the lock can be set by a downward force transmitted through the running tool to the lock and so that the locking dogs will carry both upwardly and downwardly directed forces subsequently applied to the engaged lock. The running tool can be removed from the lock, leaving the lock in place only if the lock mandrel has been shifted downward by an amount sufficient to radially expand the locking dogs. If for some reason the locking dogs have not properly engaged in the nipple recess, an attempt to retrieve the running tool will result in removal of the lock and well tool as well. If for some reason the running tool has not been shifted downwardly by sufficient amount to fully expand the locking dogs, a portion of the running tool will be left in the lock and an operator at the surface will be aware that the lock has not been properly set. The lock is set and held in position by two separate inner locking members, which in the preferred embodiment comprise radially flexible C-ring members. The interlocking members can be released only by two separate operations. The first locking member can be removed by an axial force, this axial force being ineffective to release the second interlocking member holding the lock in place. In the preferred embodiment of this invention, the second locking member can be released only by a radial force applied to the locking member. Again, in the preferred embodiment of this invention, this releasing mechanism is provided by outward expansion of a releasing member on a retrieving tool inserted into the well. The retrieving tool thus serves to apply the axial force to release one locking dog and provide a separate manipulation to release the second releasing member, in the preferred embodiment a radially outward force, as well as providing means for engaging the lock to retrieve the disengaged lock from the well. Cooperable alignment means are provided on the lock and on the retrieving tool so that the retrieving tool can be properly oriented to permit release of both locking members and retrieval of the tool. It will be apparent to those skilled in the art that the method and apparatus disclosed herein can be practiced by providing multiple, separately disengagable interlocking members which may be disengaged by other manipulations, but which will not differ from the essence of the invention disclosed herein.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A lock for anchoring a well tool in a nipple in a subterranean well, comprising:

radially expandable locking dog means for engaging the nipple;

an inner mandrel axially movable relative to the locking dog means and having a surface engaging the locking dog means upon relative axial movement to radially shift the locking dog means;

an outer housing surrounding the inner mandrel;

an inwardly biased member engaging the inner mandrel and the outer housing when inwardly flexed to prevent relative movement therebetween when the locking dog means are expanded; and at least one radially extending opening extending through the inner mandrel aligned with the inwardly biased member, whereby the inwardly biased member is expanded when engaged by a releasing member expanding through the radially extending opening to release the inner mandrel for axial movement relative to the outer housing, the locking dog means being freed for retraction to release the lock.

2. The lock of claim 1 wherein the inner mandrel is axially shiftable from a first position with the locking dog means retracted to a second position with the locking dogs expanded, the inwardly biased member being outwardly flexed in response to an axial force during movement of the inner mandrel from the first to the second position, an axial force being ineffective to outwardly flex the inwardly biased member for movement of the inner mandrel from the second to the first position.

3. The lock of claim 1 wherein the inner mandrel has a plurality of circumferentially spaced radially extending openings aligned with the inwardly biased member and further comprising aligning means on the interior of the inner mandrel for orienting a releasing member relative to the mandrel openings.

4. The lock of claim 3 wherein the aligning means comprise at least one inwardly projecting member for imparting rotation to the releasing member to orient the releasing member relative to the mandrel openings.

5. The lock of claim 1 wherein the inwardly biased member comprises a radially flexible ring member having free ends.

6. A lock for anchoring a well tool in a nipple in a subterranean well, comprising:

radially shiftable locking dog means for engaging the nipple;

a mandrel axially shiftable relative to the locking dog means and having surface means engaging the locking dog means upon relative axial movement for radially shifting the locking dog means;

a housing extending concentrically relative to the mandrel;

first interlocking means engagable with the mandrel and the housing for holding the mandrel axially fixed relative to the housing when the locking dog means is radially shifted to engage the nipple; and second interlocking means engagable with the mandrel and the housing for holding the mandrel axially fixed relative to the housing when the locking dog means is radially shifted to engage the nipple, the first interlocking means being disengagable from one of the housing and mandrel when an axial force is applied to the mandrel, an axial force on the mandrel being ineffective to disengage the second interlocking means, the second interlocking means being disengageable by a radially directed force, the mandrel being shiftable relative to the housing for retraction of the locking dog means upon disengagement of both the first and second interlocking means.

7. The lock of claim 6 wherein the first and second interlocking means comprise radially flexible members, an axial force on the mandrel radially flexing the first interlocking means and being ineffective to radially flex the second interlocking means.

8. A lock for anchoring a well tool in a nipple in a subterranean well, comprising:

radially shiftable locking dog means for engaging the nipple;

a mandrel shiftable in a first direction relative to the locking dog means and having surface means engaging the locking dog means upon relative axial movement in the first direction for radially shifting the locking dog means;

a housing extending concentrically relative to the mandrel;

first interlocking means engagable with the mandrel and the housing for holding the mandrel axially fixed relative to the housing when the locking dog means is radially shifted to engage the nipple; and second interlocking means engagable with the mandrel and the housing for holding the mandrel axially fixed relative to the housing when the locking dog means is radially shifted to engage the nipple, the first interlocking means being disengagable from one of the housing and mandrel upon application of predetermined axial force tending to shift the mandrel in a second direction opposite the first direction being ineffective to disengage the second interlocking means, the second interlocking means being disengagable by a radially directed force, the mandrel being shiftable relative to the housing for retraction of the locking dog means upon disengagement of both the first and second interlocking means.

9. Apparatus for locking a downhole tool in a nipple having a lock engaging recess and an axially spaced upwardly facing no-go shoulder to support the downhole tool in a subterranean well, the locking apparatus comprising:

an outer housing;

a downwardly facing lock no-go shoulder on the housing and cooperable with the upwardly facing nipple no-go shoulder to initially position the locking apparatus adjacent the nipple;

radially expandable locking dog means cooperable with the nipple engaging recess to anchor the lock relative to the nipple to support the well tool against oppositely directed axial forces;

means for radially expanding the locking dog means into the lock engaging recess; and an exterior surface on the locking dog means cooperable with the nipple recess for engaging the nipple to move the housing upward relative to the nipple during expansion of the locking dog means, the lower end of the locking dog means being spaced from the lock no-go shoulder by a distance less than the axial spacing between the lower end of the nipple recess and the nipple no-go shoulder with the exterior surface spanning the lower end of the nipple recess when the lock no-go shoulder engages the nipple no-go shoulder, whereby the lock and nipple no-go shoulders are disengaged during expansion of the locking dog means so that the locking dog means supports the well tool against upwardly and downwardly directed forces without subjecting the lock and nipple no-go shoulder to axial loads when the lock is engaged.

10. Apparatus for anchoring a well tool in a subterranean well having a fluid transmission conduit extending through the wellbore, comprising:

a nipple incorporable in the fluid transmission conduit having an annular recess therein and a nipple no-go axially spaced from the annular nipple recess;

a lock attachable to the well tool and further comprising, an outer housing;

locking no-go means comprising a shoulder on the housing for engaging the nipple no-go means to position the lock adjacent the nipple;

an inner mandrel axially movable relative to the outer housing;

radially expandable locking dog means cooperable with the nipple annular recess to anchor the lock and attached well tool relative to the nipple to support the well tool against oppositely directed axial forces;

cooperable means on the mandrel and on the locking dog means for radially expanding the locking dog means into the nipple annular recess; and an exterior surface on the locking dog means cooperable with the nipple recess for engaging the nipple to move the housing upward relative to the nipple during expansion of the locking dog means, the lower end of the locking dog means being spaced from the lock no-go shoulder by a distance less than the axial spacing between the lower end of the nipple recess and the nipple no-go shoulder with the exterior surface spanning the lower end of the nipple recess when the lock no-go shoulder engages the nipple no-go shoulder, whereby the lock and nipple no-go shoulders are disengaged during expansion of the locking dog means so that the locking dog means supports the well tool against upwardly and downwardly directed forces without subjecting the lock and nipple no-go shoulder to axial loads when the lock is engaged.

11. Apparatus for positioning a downhole tool in a nipple in a subterranean well and removing the downhole tool therefrom, comprising:

(a) a lock attachable to the well tool and further comprising;

radially expandable locking dogs;

a lock no-go for initially positioning the locking dogs adjacent the nipple;

an axially shiftable mandrel having means thereon for radially expanding the locking dogs upon axial movement of the mandrel;

an inwardly biased radially flexible member holding the mandrel axially fixed when the locking dogs are expanded, the inwardly biased member being disengagable from the mandrel upon radial expansion thereof;

at least one radially extending opening in the mandrel in alignment with the inwardly biased member when the locking dogs are radially expanded;

an inwardly projecting surface on the mandrel; and (b) a running tool further comprising;

disengagable means attachable with the lock for lowering the lock and downhole tool into the well until the lock no-go positions the locking dogs adjacent the nipple;

a downwardly shiftable member engagable with the lock mandrel to shift the lock mandrel upon application of a downwardly directed force; and means for applying an upwardly directed force to the disengagable means to release the running tool from the lock; and (c) a wireline retrieving tool for removing the lock from the nipple, further comprising;

at least one radially expandable releasing dog;

means for engaging the mandrel inwardly projecting surface to align the releasing dog with the radially extending mandrel opening;

a retrieving tool mandrel for radially expanding the releasing dog to expand the inwardly biased radially flexible member on the lock to release the lock mandrel; and means for locking the retrieving tool mandrel in place with the releasing dog expanded and in engagement with the lock mandrel opening whereby an upward force on the re-trieving tool mandrel shifts the lock mandrel upward to release the locking dogs from the mandrel for removal of the downhole tool.

12. A lock for anchoring a well tool in a nipple in a subterranean well, comprising:

radially expandable locking dogs for engaging the nipple;

an outer housing having radially extending openings through which the locking dogs are radially expandable;

a no-go shoulder on the outer housing for initially positioning the lock in alignment with the nipple;

means engagable with the outer housing and a running tool for lowering the lock into the well until the no-go shoulder positions the lock in alignment with the nipple;

an inner mandrel downwardly shiftable relative to the outer housing from a first to a second position and having a camming shoulder engagable with the locking dogs to radially shift the locking dogs upon movement of the mandrel relative to the outer housing to the second position, the no-go shoulder preventing downward movement of the outer housing during downward movement of the inner mandrel;

a first radially flexible member engaging the mandrel and the housing in the first and second postiions, and being disengagable with one of the housing or mandrel upon application of a predetermined axial force to the mandrel;

a second radially flexible member engaging the mandrel and the housing in the second position, the second radially flexible member being disengagable from the mandrel only upon application of a radially outward force;

at least one radial opening extending through the mandrel in alignment with the second radially flexible member when the mandrel is in the second position; and an inwardly projecting surface on the interior of the mandrel; whereby a releasing tool inserted into the mandrel is rotationally aligned with the mandrel opening upon engagement with the inwardly projecting surface so that radially expanding means on the releasing tool is extendable through the mandrel opening to disengage the second radially flexible member from the mandrel, with a subsequent application of an axial force on the mandrel disengaging the first radially flexible member so that the mandrel can be moved from the second to the first position for retraction of the locking dogs.

13. An assembly for use in retaining a well tool device in an engaged position in a subterranean well and releasing the well tool device from the engaged position, comprising:

an outer housing retainer attachable to the well tool;

an inner mandrel shiftable relative to the outer housing retainer from a first position to a second position to actuate the well tool;

an inwardly biased member engaging the inner mandrel and the outer housing retainer to prevent relative movement therebetween when the inner mandrel is in the second position;

at least one radially extending opening extending through the inner mandrel aligned with the inwardly biased member, whereby the inwardly biased member is expanded when engaged by a releasing member expanding through the radially extending opening to release the inner mandrel for axial movement relative to the outer housing retainer, the inner mandrel being released to shift from the second to the first position to release the well tool device.

14. The assembly of claim 13 wherein the inwardly biased member is outwardly flexed during movement of the inner mandrel between the first and the second position, an axial force being neffective to outwardly flex the inwardly biased member for movement of the inner mandrel from the second to the first position.

15. The assembly of claim 13 wherein the inner mandrel has a plurality of circumferentially spaced radially extending openings aligned with the inwardly biased member and further comprising aligning means on the interior of the inner mandrel for orienting a releasing member relative to the mandrel openings.

16. The assembly of claim 15 wherein the aligning means comprise at least one inwardly projecting member for imparting rotation to the releasing member to orient the releasing member relative to the mandrel openings.

17. A lock for anchoring a well tool in a nipple in a subterranean well, comprising:

radially shiftable locking dog means for engaging the nipple;

a mandrel axially shiftable relative to the locking dog means and having surface means engaging the locking dog means upon relative axial movement for rdially shifting the locking dog means;

a housing extending concentrically relative to the mandrel;

first radially flexible interlocking means engagable with the mandrel and the housing for holding the mandrel axially fixed relative to the housing when the locking dog means is radially shifted to engage the nipple; and second radially flexible interlocking means engagable with the mandrel and the housing for holding the mandrel axially fixed relative to the housing when the locking dog means is radially shifted to engage the nipple, the first interlocking means being disengagable from one of the housing and mandrel and shiftable from a first to a second position upon axial movement of the mandrel relative to the locking dog means when an axial force is applied to the mandrel to radially flex the first interlocking means, the first interlocking means being selectively engagable with spaced apart grooves on the housing in the first and second position, an axial force on the mandrel being ineffective to radially flex the second interlocking means to disengage the second interlocking means.

* * * * *